US005503389A

United States Patent [19]

Campbell

[11] Patent Number: 5,503,389

[45] Date of Patent: Apr. 2, 1996

[54] TRAINING DEVICE

[76] Inventor: John F. Campbell, 2877 Exeter Dr., Emmaus, Pa. 18049

[21] Appl. No.: 44,702

[22] Filed: Apr. 12, 1993

[51] Int. Cl.[6] ..... A63B 69/00

[52] U.S. Cl. ..... 273/1.5 A

[58] Field of Search ..... 273/1.5 A

[56] References Cited

U.S. PATENT DOCUMENTS

| | | | |
|---|---|---|---|
| 3,023,001 | 2/1962 | Gourdouze | 273/1.5 A |
| 3,717,342 | 2/1973 | Haney et al. | 273/1.5 A |
| 4,161,313 | 7/1979 | Dickey | 273/1.5 A |
| 4,621,811 | 11/1986 | Campbell | 273/1.5 A |
| 5,072,931 | 12/1991 | Carlson | 273/1.5 A X |
| 5,165,680 | 11/1992 | Cass | 273/1.5 A |
| 5,265,870 | 11/1993 | Merino | 273/1.5 A |

*Primary Examiner*—Paul E. Shapiro

[57] ABSTRACT

A training device for development skills in the game of basketball or the like sport is disclosed. The device comprises an L-shaped structure, wherein one leg of the structure is connected at each of its ends to an elevated, stationary structure, preferably a basketball hoop. The second leg of the L-shaped structure, when said first leg is connected to the stationary structure, will hang down from the horizonal axis of the stationary structure at the point of attachment of the two legs. A rope is slidably connected to the first leg, and extends from a position located proximate to the end of said first leg distal from the attachment point to a position located proximate to the end of said second leg distal from the juncture point; (d) means to attach the end of the rope located proximate to the end of the first leg distal from the juncture point to a ball, so that the ball will suspend from said rope end at a position proximate to said end of said first leg, wherein the location of the suspended ball may be controlled by a user to permit players to increase their skills by jumping to touch said ball.

16 Claims, 5 Drawing Sheets

TRAINING DEVICE

BACKGROUND OF THE INVENTION

The invention relates in general terms to a training device and more particularly to a basketball training device that emphasizes development of skills necessary for strong rebounding.

My U.S. Pat. No. 4,621,811 describes a training device that promotes the development of skills essential to the game of basketball and, in particular, skills essential to strong rebounding; such as, for example, jumping skills, ball awareness and improved timing. More particularly, my invention utilizes, in part, a hoop rim mounted on an elevated background. An angular rope support leg is attached at its proximal end by a bracket to a hoop rim so that the support leg's distal end terminates above and proximate a hoop. A rope of predetermined length is slidably connected to the support leg with one end of the rope long enough to project downward from the proximal end of the support leg so that it may be grasped by a user. The other rope end projects downward from the distal end of the support leg and receives a basketball. Suspension of the ball proximate the hoop may be controlled by a user to permit players to increase their jumping skills.

The device taught in my prior patent realizes the objects of the invention as stated in the prior patent. However, the present invention is an improvement over my prior device in that it also provides for a practicing device for increasing the jumping and other rebounding skills of a user, but utilizes a simpler basket attachment method.

DETAILED DESCRIPTION OF THE INVENTION

Figure 1:
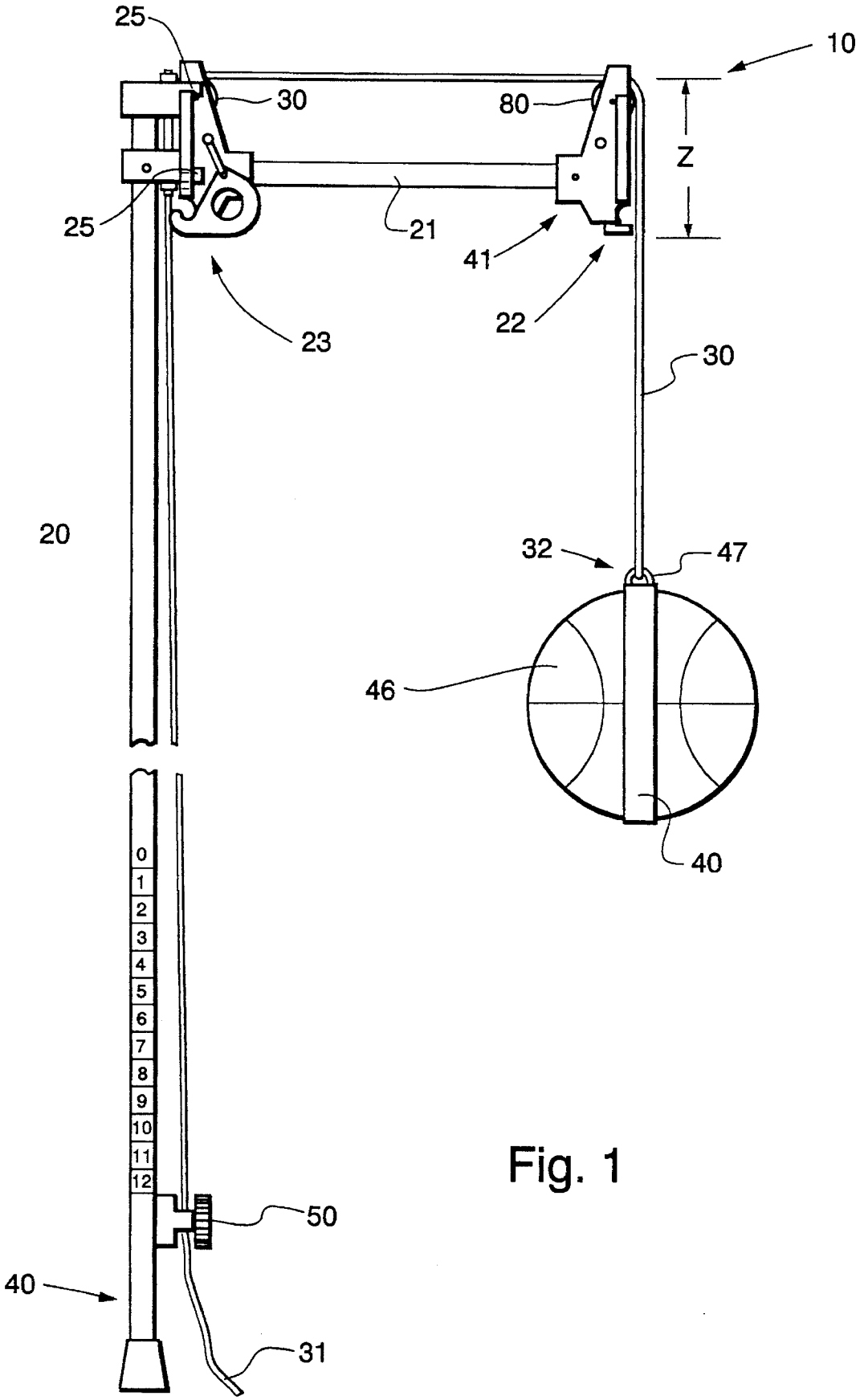
FIG. 1 is a side view of a preferred embodiment of the device of the present invention.

Referring to the FIGURES, in FIG. 1 there is depicted device 10 of the present invention.

Device 10 is, in its preferred form, substantially L-shaped, having legs 20 and 21, with leg 20 being attached to leg 21 at juncture or attachment points 25. By the term substantially L-shaped it is understood that the angle between the two legs does not have to be precisely 90°.

Figure 2:
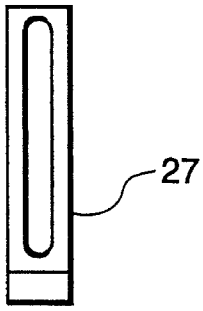
FIGS. 2–10 are detailed views of various attachment means utilized in the preferred embodiment of the present invention.
Figure 3:
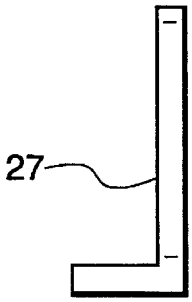
Figure 4:
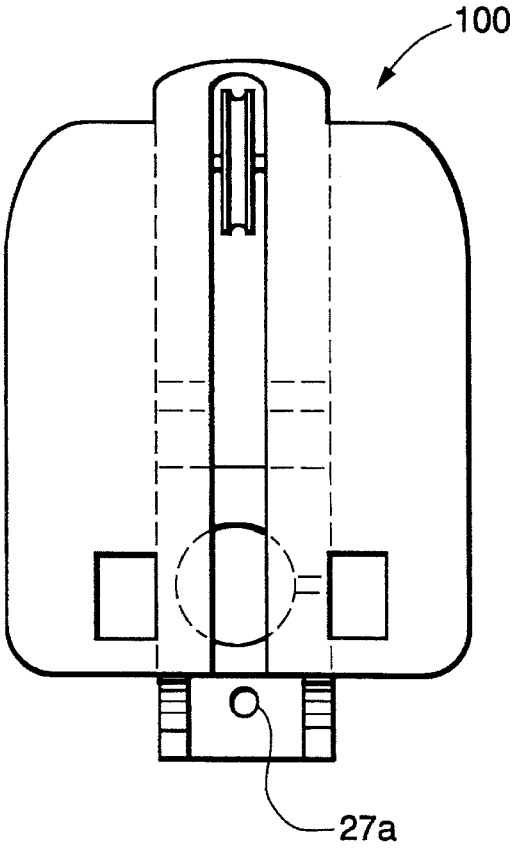
Figure 5:
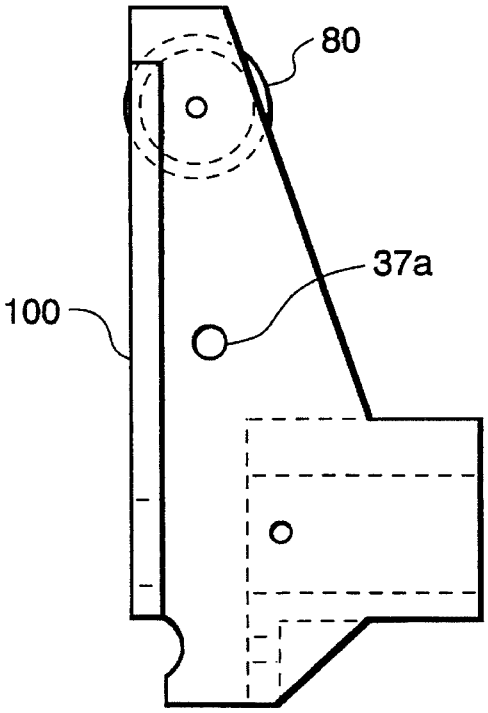
Figure 7:
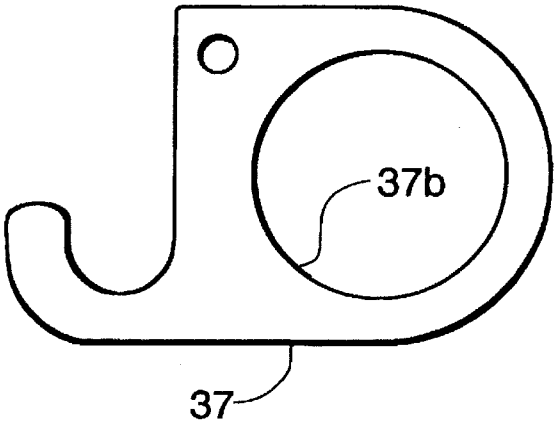
Figure 6:
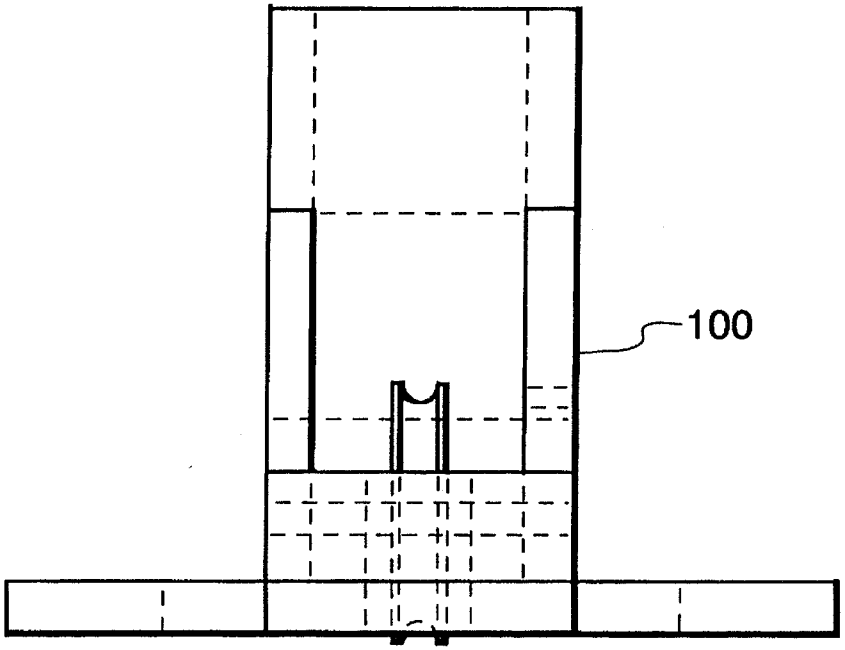

Leg 21 is designed to be attached to a basketball hoop (not shown) or another elevated stationary member at attachment points 22 and 23, which, as depicted, are bracket means which will serve to attach or release leg 21 from the stationary member. Of course, other methods of attaching leg 21 to the hoop are contemplated according to the present invention. When attached to a basketball hoop, leg 21 will of course be positioned substantially horizontally. FIGS. 4, 5 and 6 depict, respectively, front, side and top views of a typical style of bracket 100 utilized as the bracket means for attachment points 22 and 23. Adjustable clamp 27, depicted in FIG. 2 in a front view and FIG. 3 in a side view, is attached to a bracket 100 at port 27*a* to thereby form in combination attachment point 22. Hook 37, shown in a side view in FIG. 7, is attached to bracket 100 at port 37*a* to form, when used with an adjustable clamp, attachment point 23. Attachment points 22 and 23 are designed to be of a dimension sufficient to securely hold therein a section of a basketball hoop or other elevated member. It is understood that the above attachment means are exemplary only and other methods may be utilized. Preferably, leg 21 is attachable to a basketball hoop at two positions opposite each other on the hoop's circumference, and therefore in the preferred embodiment of the invention leg 21 is of a length that corresponds to the diameter of a standard basketball hoop to which it is attached. Leg 20, which in FIG. 1 is shown in fragmentary cutaway fashion, is attached to leg 21 at point 25. Leg 20 is designed in the present embodiment to hang down in a generally vertical position relative to the horizontal plane of the basketball hoop or other elevated member to which leg 21 is attached. Leg 20 will typically be of a sufficient length to allow a user to be able to grasp end 40 distal from the juncture point 25 while standing proximate to a playing surface, and leg 20 can be maneuvered to move leg 21 in a horizontal position to thereby serve to attach or release leg 21 from the hoop or other stationary member. Although, in the depicted embodiment leg 20 is releasably attached to leg 21, it is understood that in another embodiment of the present invention leg 20 may be securely attached to leg 21.

Figure 12:
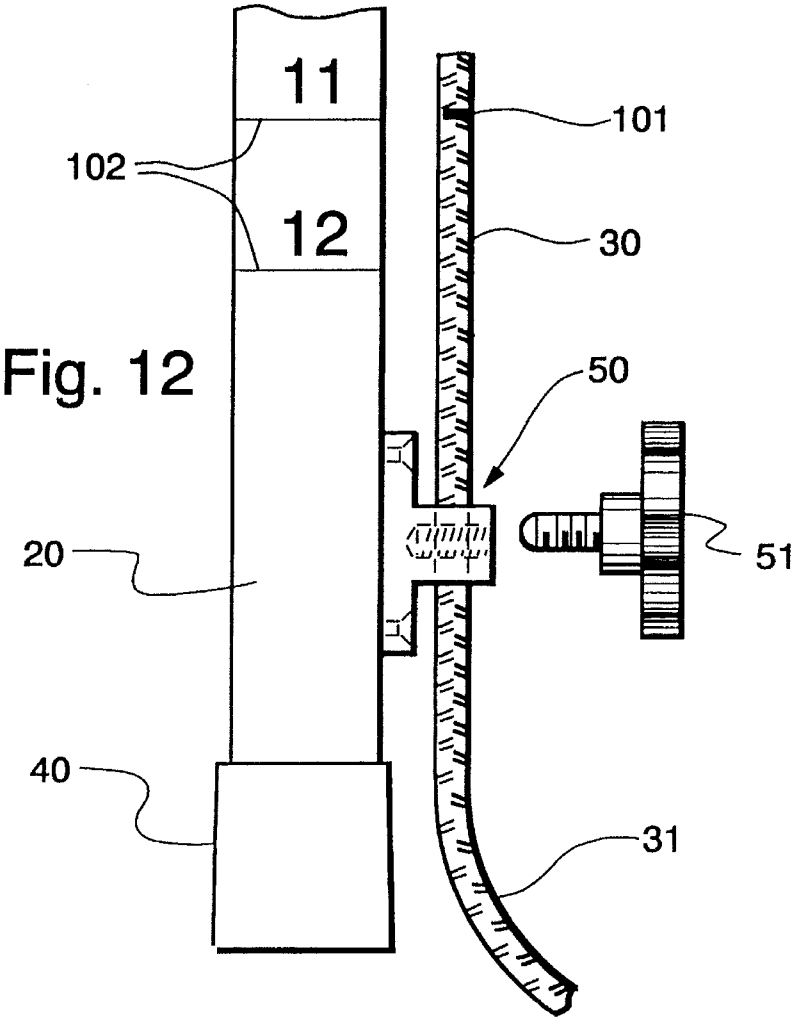
FIG. 12 is a detailed side view, of leg 20 utilized in a preferred embodiment of the present invention.
Figure 11:
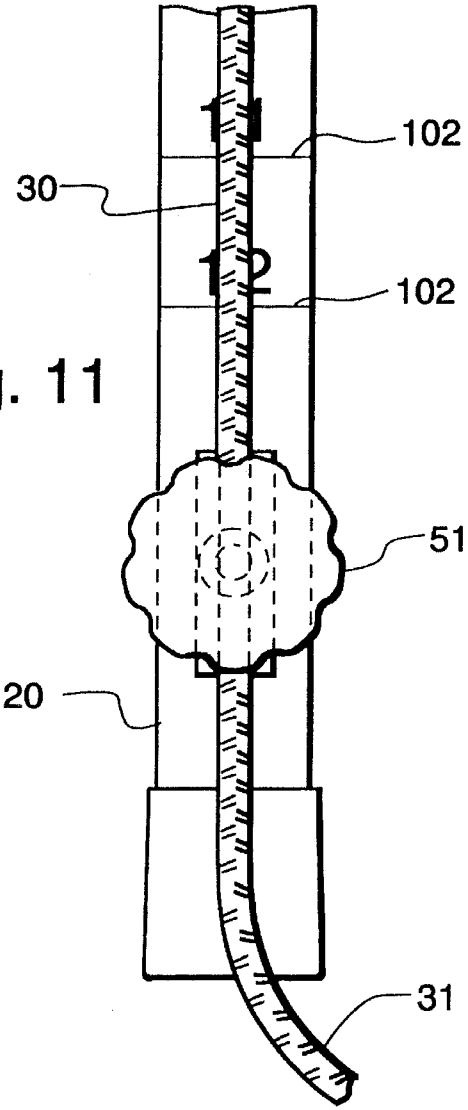
FIG. 11 is a detailed front view.

Rope 30 is slidably attached to leg 21, in the depicted embodiment by passing rope 30 over wheels 80 that have a grooved rim and are attached to leg 21, although other methods of slidably attaching rope 30 to leg 21 are of course contemplated. Rope 30 is of sufficient length to allow a user, who is standing proximate to a playing surface, to grasp one end 31 which projects downward from the general vicinity of attachment point 25 while the other end 32 of rope 30 projects downward from the general vicinity of end 41 of leg 21 that is distal from attachment point 22. Rope 30 is preferably made from a bungie cord or other elastic material, although any rope or cord may be satisfactorily utilized in the present invention. End 32 is attached to a basketball fastening means, which in the depicted embodiment is web belt 40 which surrounds ball 46 and is secured to the ball by any suitable means, such as a D ring 47. By pulling downward on end 31, rope end 32, and of course any ball thereto attached, will be raised relative to a playing surface. Likewise, if rope end 31 is allowed to be raised rope end 32 will fall relative to the playing surface. In such a fashion, a ball 46's distance from the playing surface may be controlled by a user to allow said user to gradually increase his or her skills by jumping to grasp and/or move ball 46. Rope 30 that is located proximate to end 31 may be marked off, such as is depicted in FIGS. 1, 11 and 12, in units such as foot units as shown at 101 so a user, such as by lining up a mark on rope 30 with twelve numbered inch marks 102 on leg 20, will be able to determine the distance that a ball attached to end 32 is being lowered or raised when end 31 is accordingly moved in the opposite direction. If device 10 is to be used with a standard basket rim that is 10 feet above a playing surface, rope 30 can be marked accordingly so that a user will know how far ball 46 is from a playing surface when a marked point on rope 30 is compared to a reference point on leg 20. It is a feature of the device of the present invention that end 31 of rope 30 may be secured to leg 20, as depicted in FIGS. 11 and 12 at point 50, such as by a clamp means 51. In practice the device of the present invention may be used in solidary fashion, wherein a user would attach leg 21 to a basketball hoop at points 22 and 23, raise or lower ball 46 to the desired height off the playing surface, attach end 31 of rope 30 to leg 20, and proceed to work on his or her jumping skills to grasp or move ball 46, with leg 20 hanging freely. It is a feature of the present invention that because leg 21 is securely attached to a rim at two points, leg 21 will not be dislodged from the rim during a typical practice session, even when ball 46 is pulled downward with a great deal of force. In such cases, the device should be as secure as the rim itself.

In the depicted embodiment, rope 30 is raised a distance z above distal end 41 of leg 21. The reason for this is to permit ball 46 to be raised up to or slightly above the height of a basketball rim. Accordingly, in the preferred embodiment distance z will be approximately equal to the diameter of a standard basketball. It is understood, however, that rope 30 does not have to be raised above distal end 41.

Figure 10:
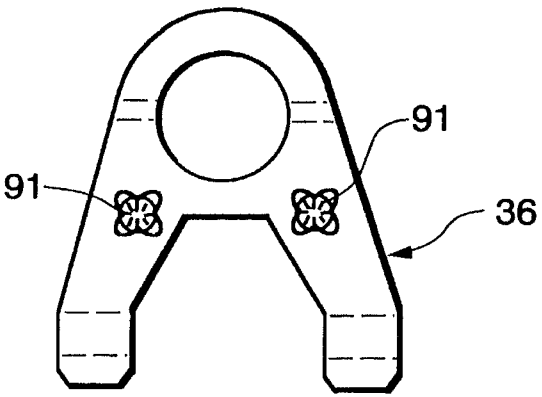
Figure 9:
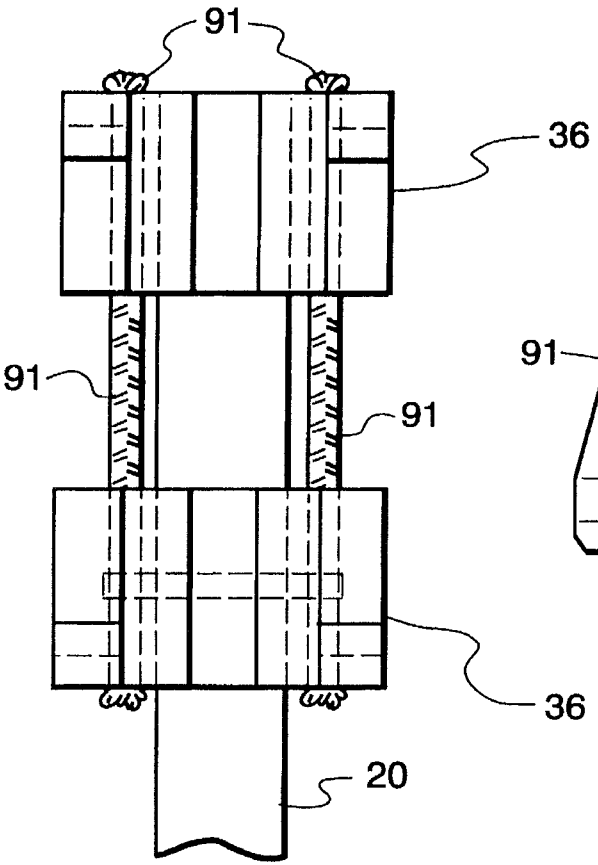
Figure 8:
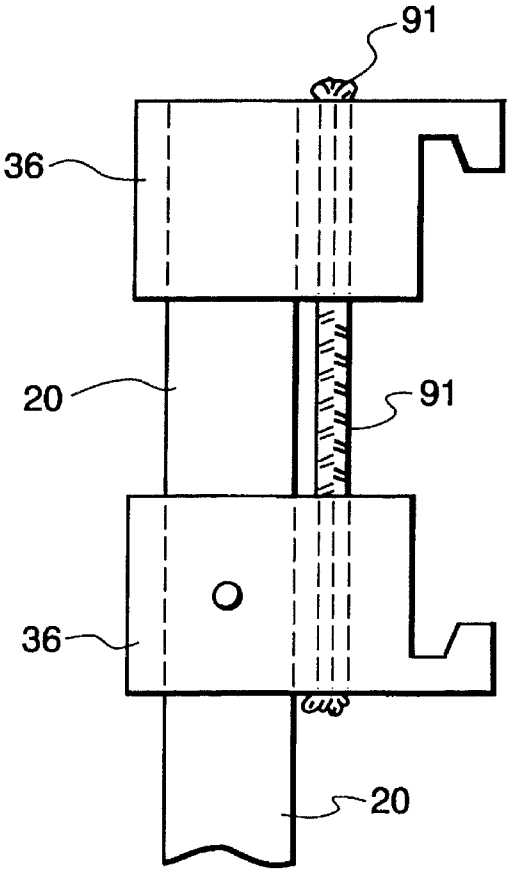

It is a feature of the preferred embodiment of the training device of the present invention that it can be attached to the basket or other elevated stationary article, and subsequently removed from said article, by the user while said user is on the ground. Therefore, the user does not have to use a ladder or a similar device to make such an attachment or removal. This is possible, in one preferred embodiment, through the use of a bungie or other stretchable material, represented in FIGS. 8 and 9 by 91, actuated clamp 36, shown in its side, front and top views, respectively, in FIGS. 8, 9 and 10, and a bungie 91 actuated hook 37. In the practice of this embodiment hook 37 attaches, via port 37*a*, to the bracket for leg 21 at attachment point 23. In one embodiment, hook 37 may be so positioned by detaching leg 20 from leg 21 and thereafter inserting clamp 51 into the large diameter opening 37*b* in hook 37, and thereafter pulling on the hook to thereby stretch the bungie cord 91 and cause leg 21 to be either attached to or removed from the stationary member.

While constructing the device of aluminum is preferred because of its light weight, any material is satisfactory.

Having now illustrated and described my invention, it is not my intention that such description limit the invention, but that the invention be limited only by a reasonable interpretation of the appended claims.

What is claimed is:

1. A training device for development skills in the game of basketball or the like sport, said device comprising:

(a) an L-shaped member having a first leg with opposite ends and a second leg, the first and second legs being attached to each other at a juncture point;

(b) means for connecting both ends of the first leg of said L-shaped support member to an elevated, generally horizontal, stationary structure so that the second leg of the L-shaped structure, when said first leg is connected to the stationary structure, will hang down from the stationary structure at the juncture point;

(c) a rope having opposite ends slidably connected to the first leg, with one end of said rope being located proximate to the end of said first leg distal from the juncture point, said rope being of sufficient length to extend downward from said juncture point to allow a user to grasp the other end while standing proximate a playing surface;

(d) means to attach the end of the rope located proximate to the end of the first leg distal from the juncture point to a ball, so that the ball will suspend from said rope end at a position proximate to said end of said first leg, wherein the location of the suspended ball may be controlled by a user by moving the other end of the rope to permit players to increase their skills by jumping to touch said ball.

2. The device of claim 1 wherein said stationary member is a basketball hoop, and the length of the first leg is substantially equal to the diameter of the hoop.

3. The device of claim 1 wherein said rope has elastic properties.

4. The device of claim 3 wherein the rope is a bungie cord.

5. The device of claim 1 including means for securing the rope near the other end to the second leg.

6. The device of claim 1 wherein the rope is raised above the end of said first leg distal from the juncture point to a distance no greater than the radius of a standard basketball.

7. The device of claim 1 including means for detachably connecting the second leg to said first leg.

8. The device of claim 1 wherein both (1) the rope adjacent to the end of an second leg distal from the juncture point and (2) a portion of the second leg distal from the juncture point, are marked with predetermined units so that by lining up a mark on the rope with a mark on the leg a user can determine how far the end of the rope holding the basketball is raised from the playing surface.

9. The device of claim 1 wherein the means for connecting the ends of the first leg of said L-shaped support member to the elevated member are brackets.

10. A training device for development skills in the game of basketball or the like sport, said device comprising:

(a) an L-shaped rope support member having a first and second leg each leg having opposite ends;

(b) means for connecting both ends of the first leg of said L-shaped support member to an elevated, stationary basketball hoop so that the second leg of the L-shaped structure, when said first leg is connected to the basketball hoop, will hang down from the basketball hoop;

(c) an elastic rope of a predetermined length and having opposite end slidably connected from a position located proximate to the distal end of said first leg to a position located proximate to the distal end of said second leg;

(d) means to attach the end of the rope located proximate to the distal end of the first leg to a ball, so that the ball will suspend below the end of the first leg, so that the ball's suspension from the rope proximate to the distal end of the first leg of said L-shaped member may be controlled by said user to permit players to increase their skills by jumping to touch said ball.

11. The device of claim 10 wherein the rope is a bungie cord.

12. The device of claim 10 including means for detachably connecting the second leg to the second leg.

13. The device of claim 10 wherein the rope is raised above the end of said first leg distal from the juncture point to a distance no greater than the radius of a standard basketball.

14. The device of claim 10 including means for detachably connecting the second leg to said first leg.

15. The device of claim 10 wherein both (1) the rope adjacent to the end of the distal second leg and (2) a portion of the second leg distal from the first leg, are marked with predetermined units so that by lining up a mark on the rope with a mark on the leg a user can determine how far the end of the rope holding the basketball is raised from the playing surface.

16. The device of claim 10 wherein the means for connecting the ends of the first leg of said L-shaped support member to the elevated member are brackets.

* * * * *